US009568294B2

(12) United States Patent
Morris et al.

(10) Patent No.: US 9,568,294 B2
(45) Date of Patent: Feb. 14, 2017

(54) SIGNAL ENCRYPTED DIGITAL DETONATOR SYSTEM

(71) Applicant: Ensign-Bickford Aerospace & Defense Company, Simsbury, CT (US)

(72) Inventors: Marc A. Morris, Clarksville, TN (US); Karl Edminster, Fairhaven, MA (US); Andrew DeMedeiros, Fall River, MA (US); Stephen W. Bartholomew, Simsbury, CT (US)

(73) Assignee: ENSIGN-BICKFORD AEROSPACE & DEFENSE COMPANY, Simsbury, CT (US)

( * ) Notice: Subject to any disclaimer, the term of this patent is extended or adjusted under 35 U.S.C. 154(b) by 449 days.

(21) Appl. No.: 14/197,935

(22) Filed: Mar. 5, 2014

(65) Prior Publication Data

US 2016/0223310 A1 Aug. 4, 2016

Related U.S. Application Data

(60) Provisional application No. 61/774,613, filed on Mar. 8, 2013.

(51) Int. Cl.

| | |
|---|---|
| ***F23Q 7/02*** | (2006.01) |
| ***F42D 1/04*** | (2006.01) |
| ***F42C 13/06*** | (2006.01) |
| ***G10K 11/18*** | (2006.01) |

(52) U.S. Cl.

CPC ..... *F42D 1/04* (2013.01); *F42C 13/06* (2013.01); *G10K 11/18* (2013.01)

(58) Field of Classification Search

CPC ..... F42D 1/04; F42C 13/06; G10K 11/18

USPC ..... 102/215

See application file for complete search history.

(56) References Cited

U.S. PATENT DOCUMENTS

| | | | | |
|---|---|---|---|---|
| 3,226,670 | A * | 12/1965 | Richard | G01S 15/101 102/341 |
| 3,648,636 | A * | 3/1972 | Mentcher | F41G 7/00 102/384 |
| 3,780,654 | A | 12/1973 | Shimizu et al. | |
| 3,971,317 | A * | 7/1976 | Gemmell | F42D 1/045 102/313 |

(Continued)

FOREIGN PATENT DOCUMENTS

| | | |
|---|---|---|
| EP | 0375872 | 7/1990 |
| WO | 2011038449 | 4/2011 |

OTHER PUBLICATIONS

Notification of Transnittal of the International Search Report and the Written Opinion of the International Searching Authority, or the Declaration for PCT/US14/21674; Date of Issuance Oct. 16, 2014; Date of Mailing Nov. 18, 2014; 12 pages.

*Primary Examiner* — Samir Abdosh
(74) *Attorney, Agent, or Firm* — Cantor Colburn LLP

(57) ABSTRACT

A remote detonator system is provided. The remote detonator system includes a receiver and a transmitter. The receiver includes a transducer configured to receive an ultrasonic acoustic signal. The transducer is electrically coupled to a first controller, the first controller having a processor responsive to executable computer instructions for detonating a charge in response to the transducer receiving the ultrasonic acoustic signal. A transmitter is provided having a transmitter configured to selectively emit the ultrasonic acoustic signal in response to an actuation by an operator.

18 Claims, 17 Drawing Sheets

(56) References Cited

U.S. PATENT DOCUMENTS

| | | | | | |
|---|---|---|---|---|---|
| 4,031,826 | A | * | 6/1977 | Gemmell | E21B 43/263 102/322 |
| 4,037,538 | A | | 7/1977 | Andrews et al. | |
| 4,478,149 | A | * | 10/1984 | Backstein | F42B 22/04 102/215 |
| 4,495,849 | A | | 1/1985 | Cooke et al. | |
| 4,616,590 | A | | 10/1986 | Albertini et al. | |
| 4,680,584 | A | | 7/1987 | Newsom et al. | |
| 4,685,396 | A | | 8/1987 | Birse et al. | |
| 4,884,506 | A | | 12/1989 | Guerreri | |
| 5,014,622 | A | | 5/1991 | Jullian | |
| 5,229,541 | A | * | 7/1993 | Will | F42C 15/42 102/202.1 |
| 5,488,908 | A | | 2/1996 | Gilpin et al. | |
| 5,894,103 | A | | 4/1999 | Shann | |
| 6,227,114 | B1 | | 5/2001 | Wu et al. | |
| 6,247,408 | B1 | | 6/2001 | Andrejkovies et al. | |
| 6,763,883 | B2 | | 7/2004 | Green et al. | |
| 6,802,237 | B1 | * | 10/2004 | Jones | B63G 7/02 102/402 |
| 7,383,882 | B2 | | 6/2008 | Lerche et al. | |
| 7,810,430 | B2 | | 10/2010 | Chan et al. | |
| 2008/0302264 | A1 | | 12/2008 | Hummel et al. | |
| 2009/0193993 | A1 | | 8/2009 | Hummel et al. | |
| 2013/0000908 | A1 | | 1/2013 | Wlaters et al. | |

* cited by examiner

FIG. 1
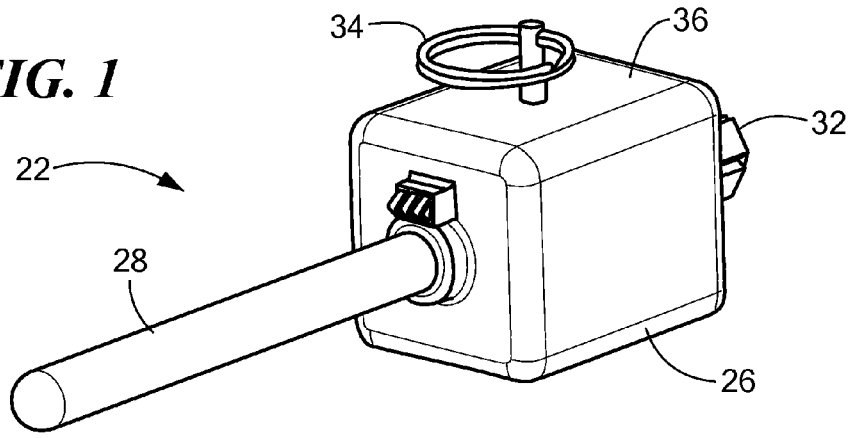
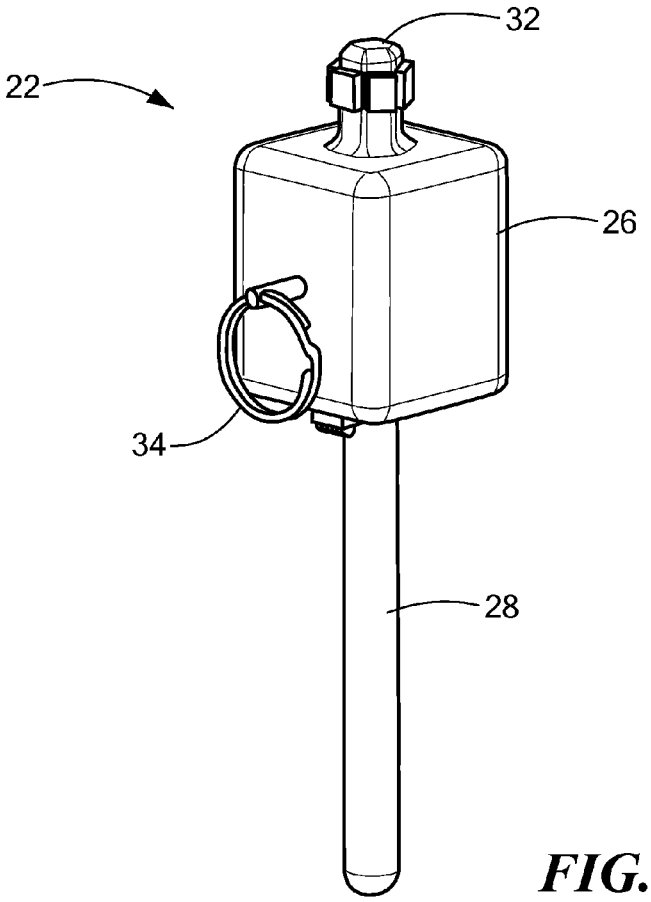
FIG. 2

SIGNAL ENCRYPTED DIGITAL DETONATOR SYSTEM

CROSS-REFERENCE TO RELATED APPLICATIONS

The present Application is a nonprovisional application of U.S. Provisional Application Ser. No. 61/774,613 filed on Mar. 8, 2013 entitled "Signal Encrypted Digital Detonator System," the contents of which are incorporated by reference herein in its entirety.

BACKGROUND OF THE INVENTION

The subject matter disclosed herein relates to a remote detonator system for explosive charges and in particular to a remote detonator system having wireless communications between a transmitter and a detonator.

Explosive charges are used in a wide variety of applications, such as mining operators, building demolition and in military and police operations. The initiation of the explosive charge is performed by a detonator device that typically uses an electrical charge to ignite a small explosive such as a blasting cap for example. Traditionally, the blasting cap was physically connected to an ignition switch using a conductor such as copper cable. To initiate the detonator, the operator connects the conductor to the switch once the area where the explosive charge is clear of personnel and actuates the switch. The use of a physical conductor provides a number of advantages in reliability and safety.

However, physical conductors also introduce a number of issues. In applications such as mining, many explosive charges may be set and configured to detonate in a desired sequence. The use of physical conductors to connect with each of the charges is labor intensive and dependent on the accuracy and attention of the operator to ensure the large number of conductors are properly installed and coupled to the switch. A misconnected conductor increases the risk of detonating the explosives in the wrong sequence. In other applications, such as military operations, the use of a physical wire is undesirable as it increases the weight of equipment the personnel have to carry and may expose the personnel to opposing forces while the conductor is being disbursed and is subject to damage prior to actuation of the detonator. Further, physical wires are susceptible to induced currents due to radio frequency electromagnetic fields created by radios and other wireless communications devices. This induced current may in certain circumstances cause a premature detonation of the explosive charge.

Other types of physical connections have also been proposed, such as but not limited to shock tubes, optical cables, low energy detonating cord (LEDC) and the like. While each of these has its own advantages, since the connections are physical, care must still be taken by the operator during installation. Further, physical connections may also become a tripping hazard for friendly forces or provide a means for an opposing force to locate either the explosive charge or personnel.

To avoid these issues, wireless detonator systems have been proposed. The use of a wireless system solves the labor issue of the having to install a conductor and also reduces the installation time for military personnel. However wireless detonator systems have provided their own challenges. First, since there is no physical conductor, the detonator needs to include an energy source to initiate the detonator. This presents a risk of inadvertent detonator actuation. Further, many of these systems use radio frequency (RF) communications. An RF based communications system uses an antenna to acquire the signal. This can be problematic in some applications, such as a battlefield where the RF spectrum is heavily used. Since RF signals are an electromagnetic wave, stray (and directed) RF signals may induce an electrical current in the antenna, which presents a risk of inadvertent detonator actuation. Further, RF communication is susceptible to electromagnetic jamming by both friendly and opposing forces, which could prevent initiation of an explosive charge.

Other wireless systems, such as optical or laser systems have also been proposed. These resolve the issue of interference, induced voltage and jamming. However an optical based system requires a line of sight connection with no obstacles for communicating the signal from the switch to the detonator. This situation may not be possible in some applications, such as urban warfare where the operator may be several rooms away from the explosive charge. Further, a line of sight system may expose the operators to opposing forces or otherwise reveal their position.

Accordingly, while existing detonator systems are suitable for their intended purposes the need for improvement remains particularly in providing a wireless communication system between a detonation transmitter and a detonator that does not utilize radio frequency communications.

BRIEF DESCRIPTION OF THE INVENTION

According to one aspect of the invention, a remote detonator is provided. The remote detonator includes a first receiver and a transmitter. The first receiver includes a first transducer configured to receive an ultrasonic acoustic signal, the first transducer being electrically coupled to a first controller, the first controller having a processor responsive to executable computer instructions for detonating a first charge in response to the first transducer receiving the ultrasonic acoustic signal. The transmitter includes a second transducer configured to selectively emit the ultrasonic acoustic signal in response to an actuation by an operator.

According to another aspect of the invention, a method of detonating an explosive charge is provided. The method includes coupling a first receiver to an transmitter. A predetermined code is transmitted from the transmitter to the first receiver. The first receiver is positioned with the charge remote from the transmitter. An ultrasonic acoustic signal is transmitted from the transmitter, the ultrasonic acoustic signal including at least the predetermined code. A plurality of acoustic signals are received with the first receiver. It is determined whether he received plurality of acoustic signals includes the ultrasonic acoustic signal. The explosive charge is detonated with the first receiver.

According to yet another aspect of the invention, A remote detonator is provided. The remote detonator includes a receiver and a transmitter. The receiver includes a housing with a projection on one side and a first acoustic transducer on an opposite side, the projection including a detonator, the first acoustic transducer configured to receive an ultrasonic acoustic signal, the first acoustic transducer being electrically coupled to a first controller disposed in the housing, the first controller having a processor responsive to executable computer instructions for transferring an electrical charge in response to the first acoustic transducer receiving the ultrasonic acoustic signal. The transmitter is removably coupled to the receiver, the transmitter having a body with an opening sized to receive and electrically couple with the projection, wherein the transmitter configured to emit the ultrasonic acoustic signal in response to a actuation by an operator.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 1 is a perspective view of a receiver for detonating an explosive charge in accordance with an embodiment of the invention;

FIG. 2 is another perspective view of the receiver of FIG. 1;

The detailed description explains embodiments of the invention, together with advantages and features, by way of example with reference to the drawings.

DETAILED DESCRIPTION OF THE INVENTION

Embodiments of the present invention provide for a remote detonation system for detonating explosive charges without the use of a physical connection between the operator and the detonator device. Embodiments of the invention provide advantages in allowing the operator to initiate the detonation wirelessly with no or low risk of the signal being blocked (jamming) by opposing forces or stray signals inducing a voltage in the detonator. Still further embodiments of the invention provide advantages in providing reliable communications between the operator and the detonator device in the presence of contaminating signals, such as sound, light and a broad range of electromagnetic or other radio frequency emissions.

Referring now to the FIGs. a wireless remote detonator system 20 is provided. The detonator system 20 includes a receiver 22 and a transmitter 24. As will be discussed in more detail herein, the receiver 22 is adapted to couple with an explosive charge, such as a blasting cap for example, that detonates an explosive charge in response to receiving an acoustic signal that includes a predetermined detonation code. In the exemplary embodiment, the acoustic signal is transmitted in the ultrasonic or higher frequency range.

Figure 3:
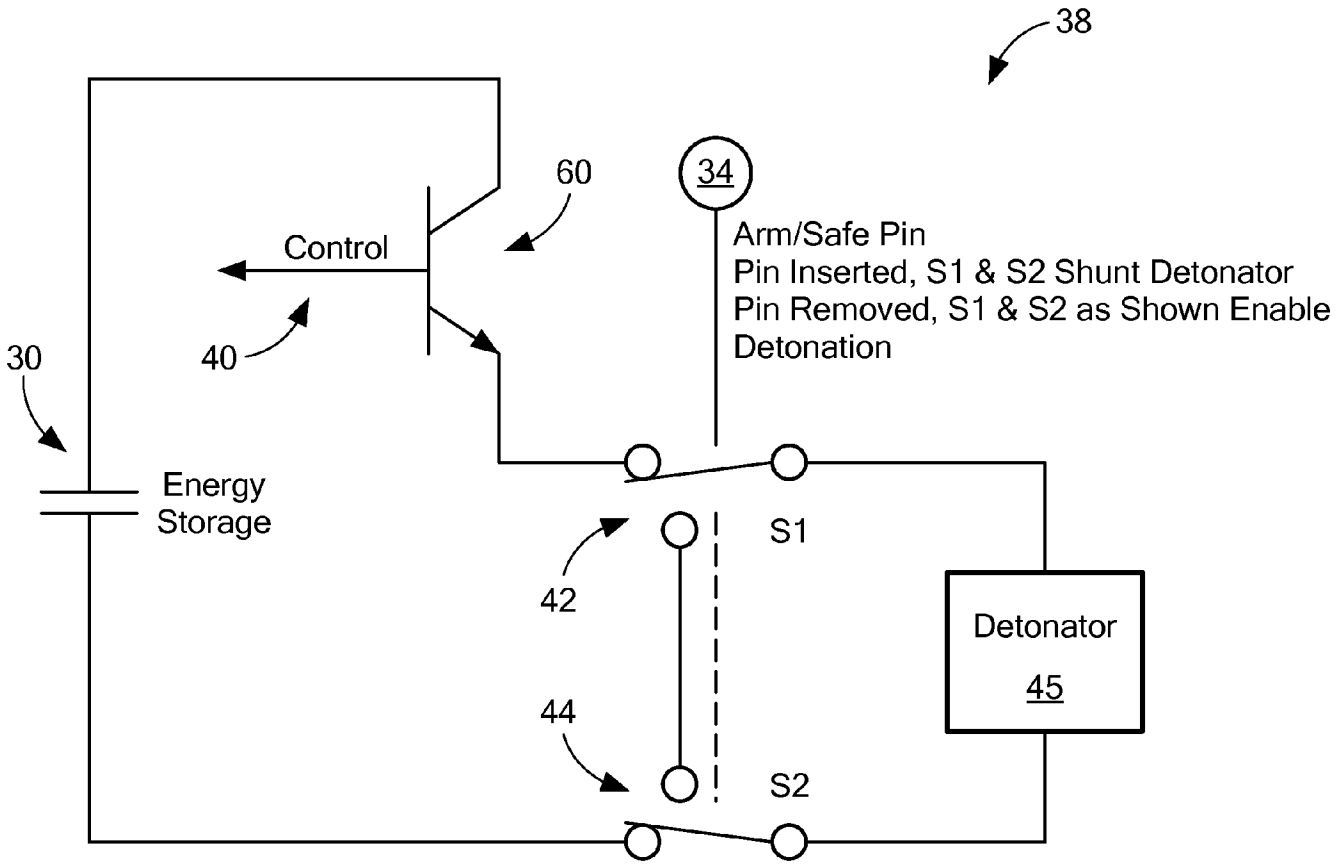
FIG. 3 is a schematic circuit diagram of the receiver of FIG. 1.

The receiver 22 includes a housing 26 having a projection 28 extending from one side (FIGS. 1-2). In the exemplary embodiment, the detonator 45 (i.e. a blasting cap) is positioned within the projection 28. In another embodiment, the projection 28 is configured to transfer electrical energy between an energy storage device 30 (FIG. 3) within the housing 26 and an external detonator (not shown). Opposite the projection 28 is a transducer 32 configured to receive and convert ultrasonic acoustic sounds into an electrical signal. In the exemplary embodiment, the transducer 32 is a Model SPM0404UD5 manufactured by Knowles Acoustics. A safety pin 34 extends through a side wall 36 of the housing 26. The safety pin 34 may incorporate a pull ring to facilitate removal. The safety pin 34 provides a physical break in a circuit that prevents inadvertent discharge of the stored electrical charge in energy storage device 30. In one embodiment, the receiver 22 further includes a set of contacts 31 arranged adjacent the projection 28. The contacts 31 engage corresponding contacts on the transmitter 24 to allow synchronization, data transfer and electrical transfer from the transmitter 24 to the receiver 22. In another embodiment, the synchronization and data transfer occurs through an inductive coupling system (not shown).

The receiver 22 further includes a circuit 38 arranged within the housing 26. The circuit 38 includes the energy storage device 30 coupled to a control circuit 40 and a pair of switches 42, 44. In the one embodiment, the energy storage device 30 is a capacitor and is capable of holding the charge for at least four (4) hours. The control circuit 40 moves between an open and closed position. The switches 42, 44 separate the energy source 30 from the detonator 45 to prevent the flow of electrical current when the switches 42, 44 are open and the detonator 45 is shunted. The switches 42, 44 are actuated by the safety pin 34 such that the switches 42, 44 are open when the safety pin 34 is installed and closed when the safety pin 34 is removed. It should be appreciated that the safety pin 34 may be reinserted after removal to open the switches 42, 44 and prevent detonation of the explosive charge.

Figure 4:
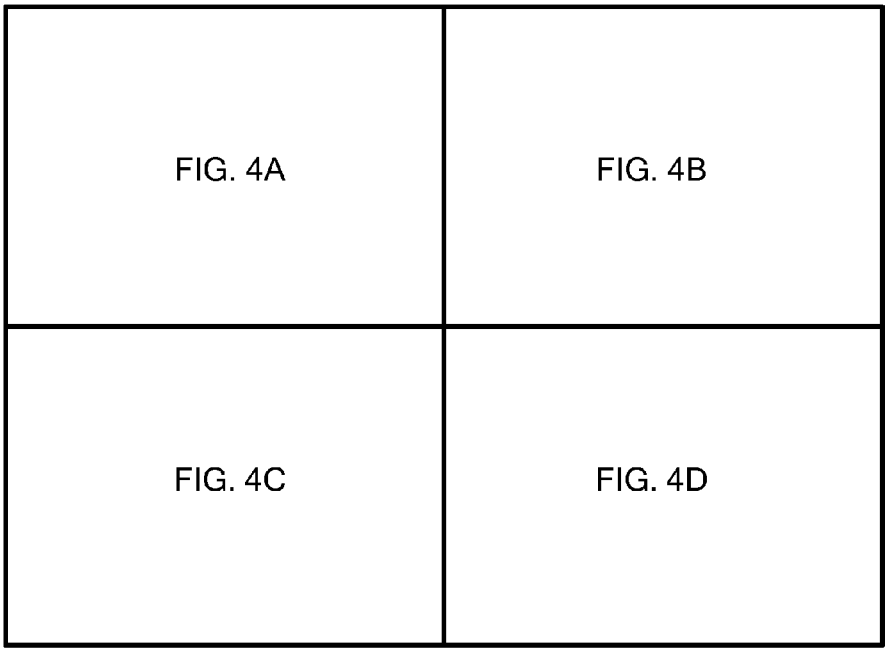
FIG. 4, including
Figure 4A:
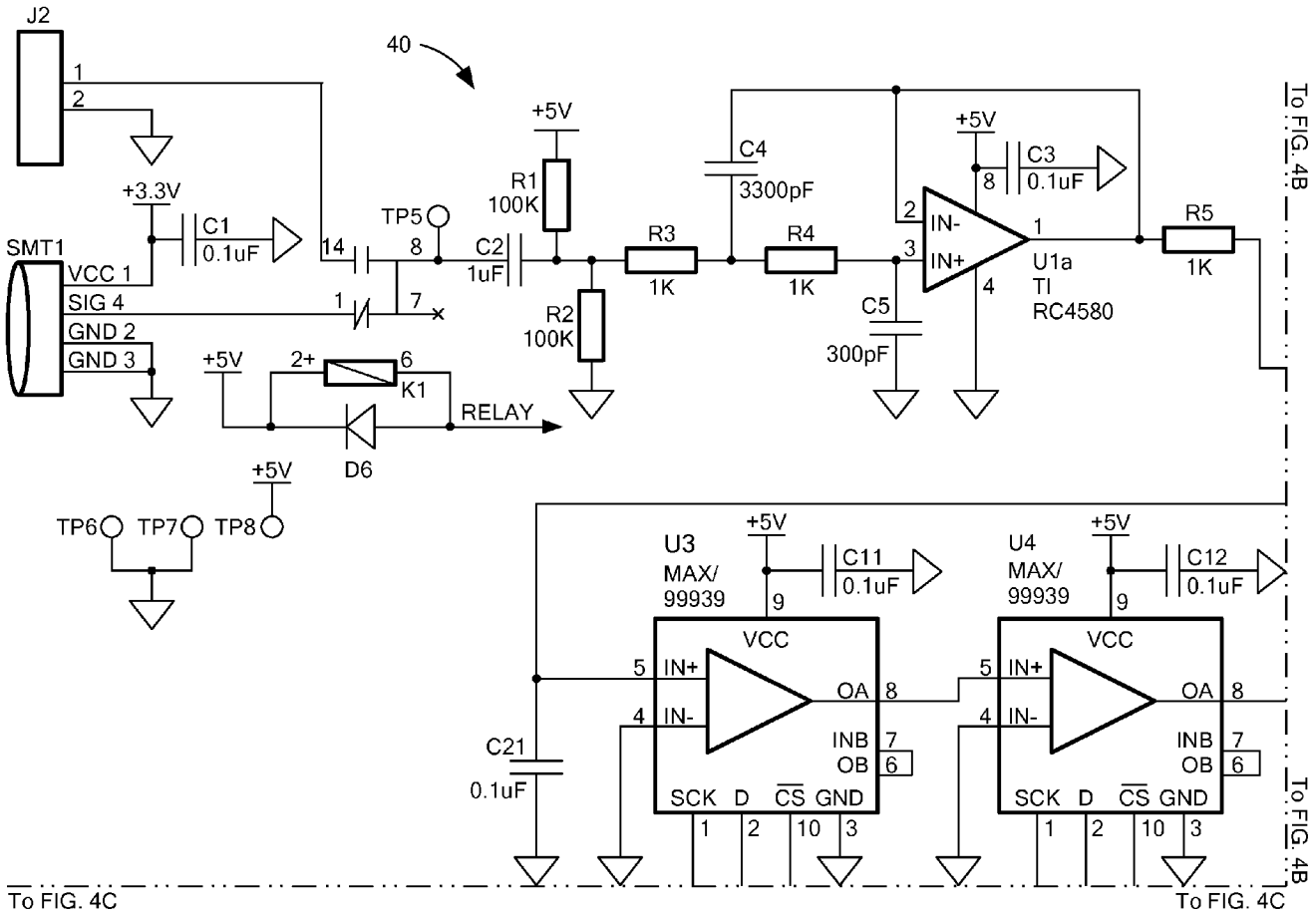
FIGS. 4A - 4D, is a schematic circuit diagram of the control circuit for the receiver of FIG. 1.
Figure 4B:
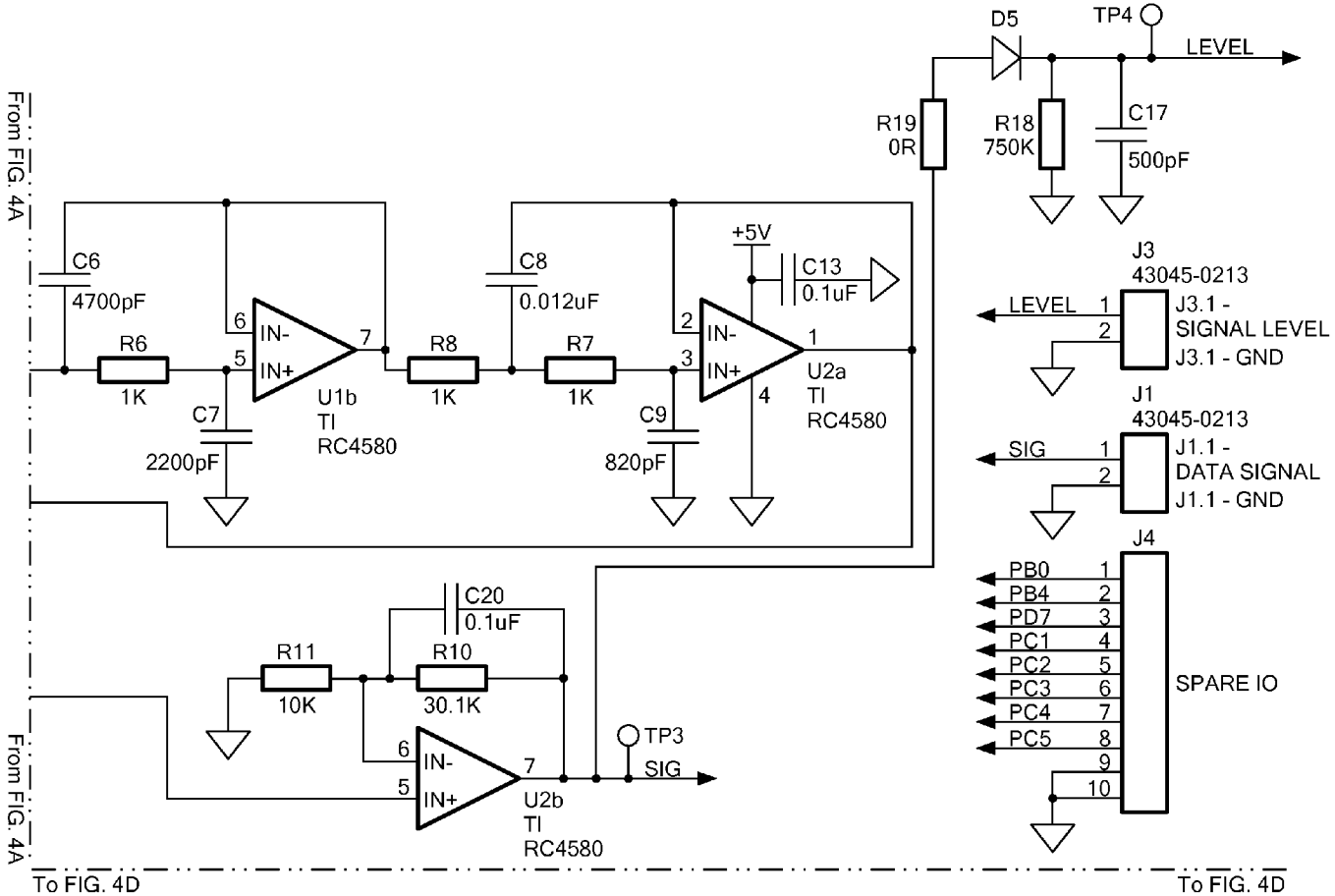
Figure 4C:
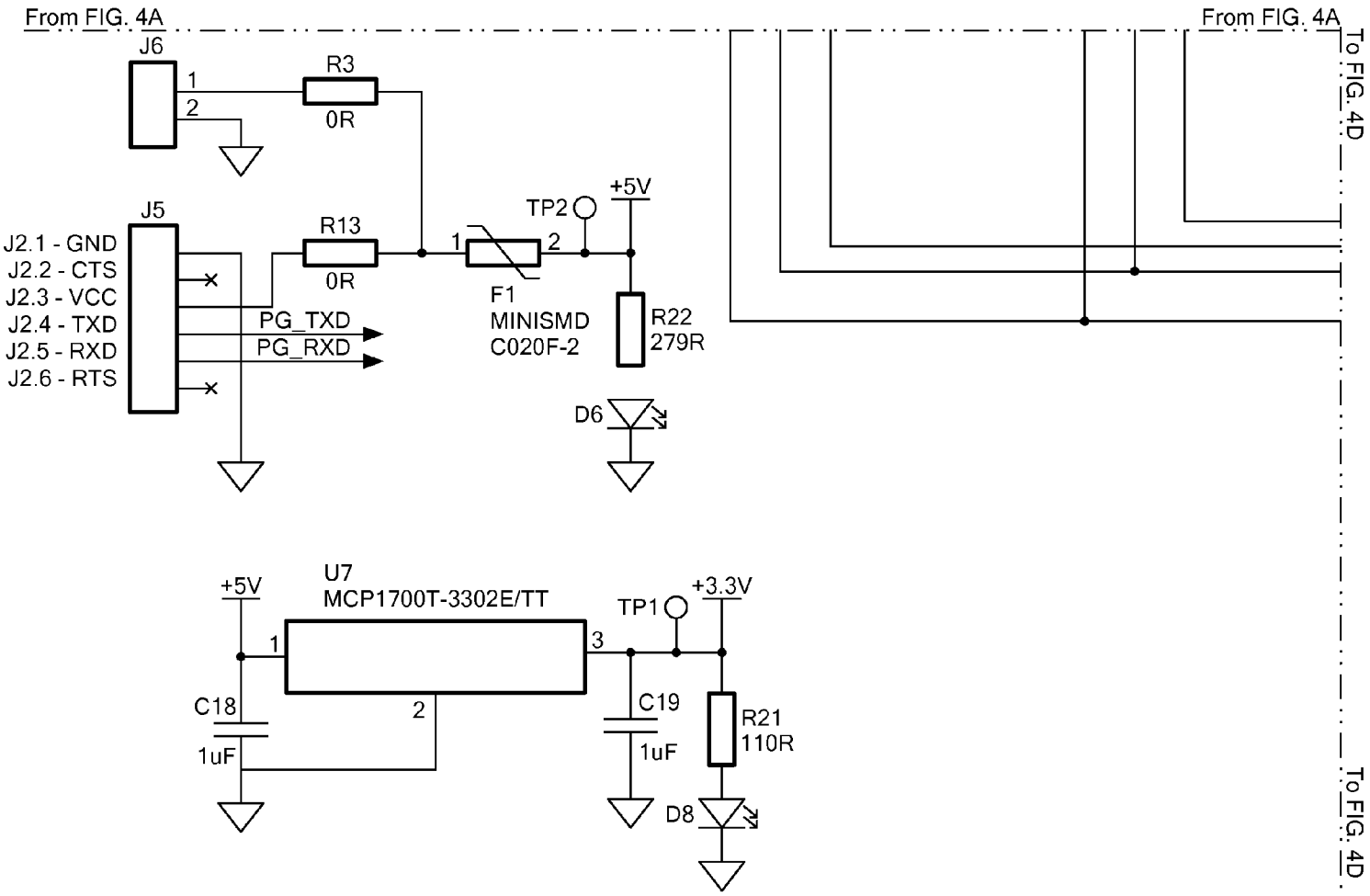
Figure 4D:
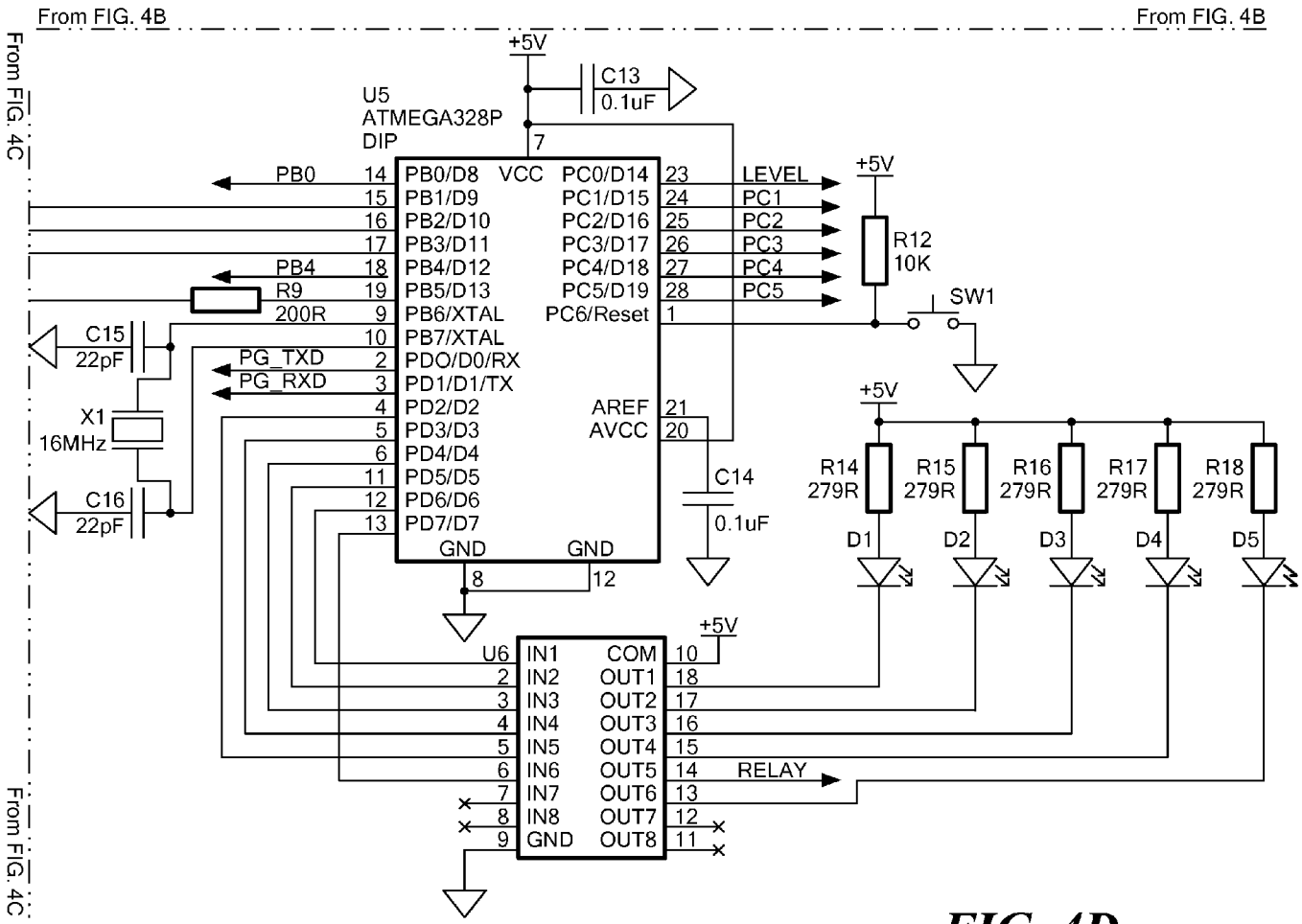
Figure 5:
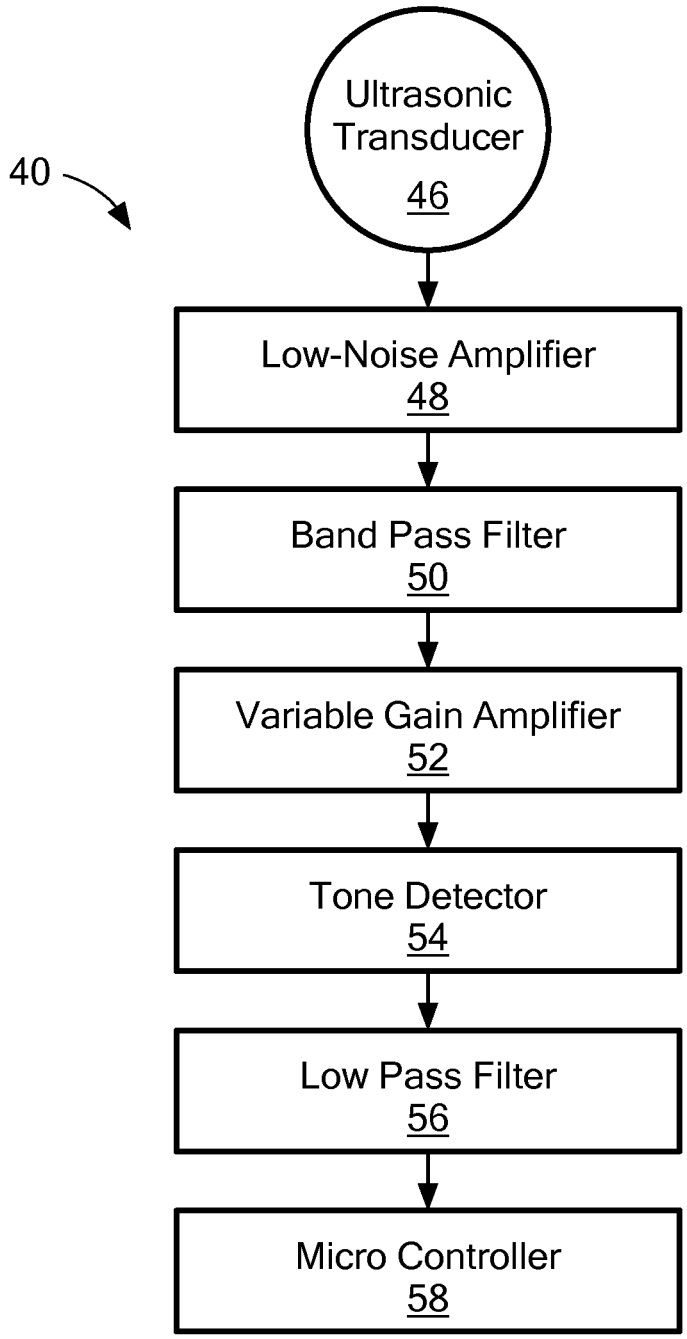
FIG. 5 is a block diagram of the circuit of FIG. 4.

The receiver 22 includes control circuit 40 shown in FIGS. 4-5 for detonating the detonator 45. The control circuit 40 is illustrated schematically in FIG. 4 and as a block diagram in FIG. 5. The control circuit 40 includes a transducer 46 that is configured to convert ultrasonic acoustic sounds into an electrical signal. The receiver 22 further includes digital signal processing for filtering and analyzing the incoming signal. In the exemplary embodiment, the electrical signal is transferred to a low noise amplifier 48. The low noise amplifier amplifies the incoming signal and transfers it to a band pass filter 50 that filters the signal around the frequency of interest. In one embodiment, the frequency of interest is about 25 kHz. Since the attenuation of the signal may be unpredictable, the signal is modified using a variable gain amplifier 52 that maintains the signal between two desired voltage levels. Amplifying if the signal is attenuated and attenuating if the signal is over range. In one embodiment, the output signal from the variable gain amplifier 52 is maintained between 2 volts and 4 volts. The signal is then analyzed by a tone detector 54. If the desired frequency (i.e. 25 kHz) is present, a logic "0" is output, while any other signal outputs a logic "1". This output signal is then inverted with the low pass filter 56 to yield the data transmitted via the acoustic signal. The data is evaluated by a processor 58.

It should be appreciated that while embodiments herein describe the desired frequency as being about 25 kHz, the claimed invention should not be so limited. In other embodiments, the desired frequency may be other frequencies or the frequency may be determined during the synchronization process. In still other embodiments, the desired frequency may be operator defined.

As will be discussed in more detail below, the ultrasonic acoustic signal is encoded with a predetermined code, which when present in the acoustic signal enables the microprocessor 58 to close the control switch 60. If the safety pin 34 has been removed and the processor 58 closes the control switch 60, electrical current will flow from the energy storage device 30 into the projection 28 to initiate the detonator 45.

In one embodiment, the receiver 22 is configured to allow bidirectional communication with the transmitter. In one embodiment, the energy storage device 30 is sized to provide power for the bidirectional communication. It is estimated that the energy storage device 30 would need to store an additional 4.2 joules of energy in addition to the energy for initiating detonation in order to transmit 100 feet.

Figure 6:
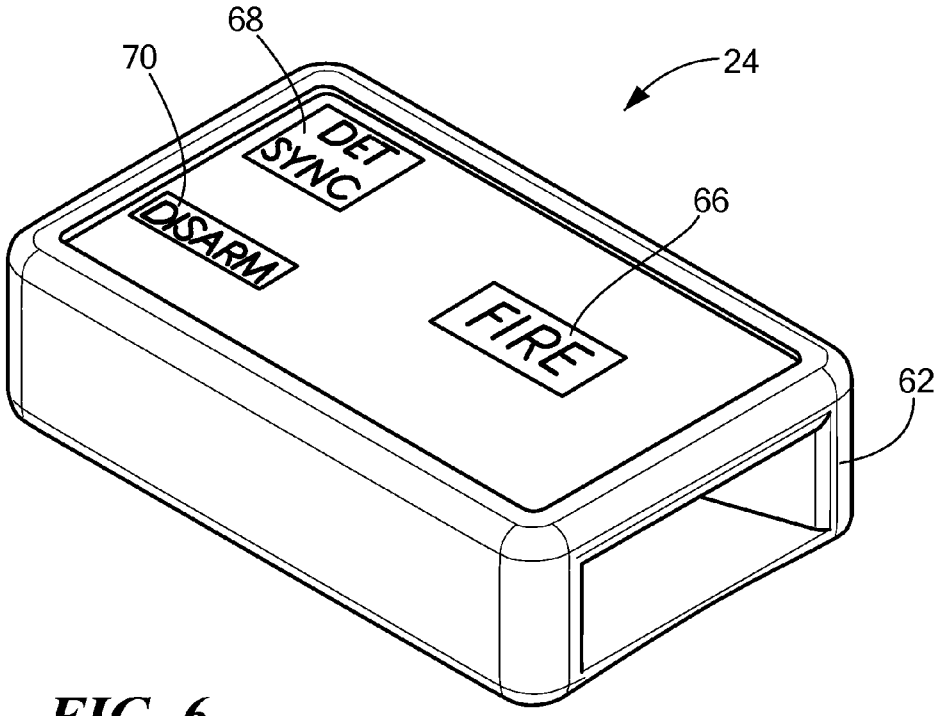
FIG. 6 is a perspective view of an transmitter in accordance with an embodiment of the invention.
Figure 7:
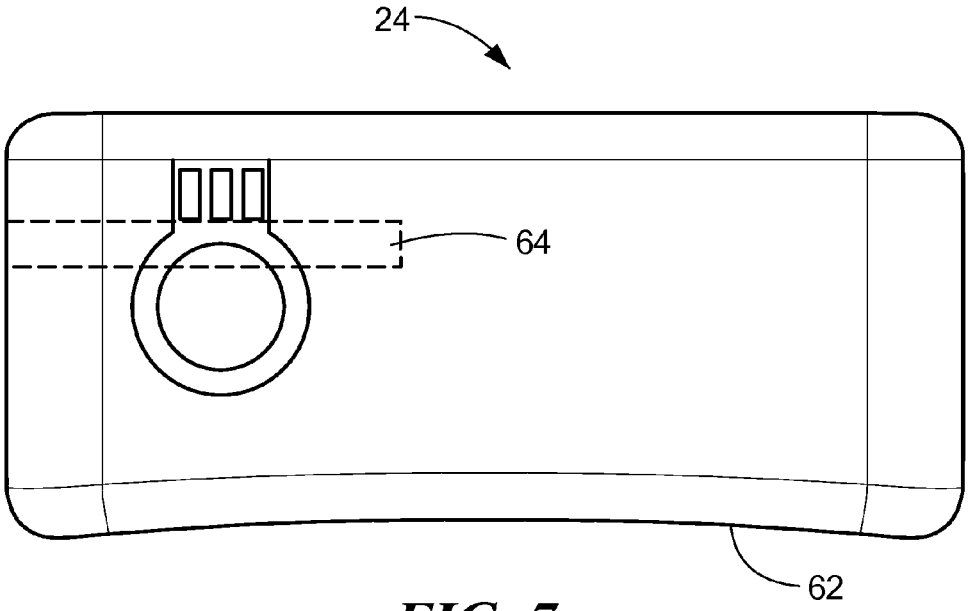
FIG. 7 is a side view of the transmitter of FIG. 6.

The transmitter device 24 shown in FIGS. 6 and 7 transmits an ultrasonic acoustic signal upon actuation by the operator. The transmitter 24 includes a body 62 having a generally rectangular shape. The body includes an opening 64 on one end that is sized to receive the projection 28 of receiver 22. The body further includes a plurality of actuators 66, 68, 70. The actuator 66 is a "fire" selector that allows the operator to transmit the ultrasonic acoustic signal to the receiver 22. The actuator 68 is a synchronization selector which allows the operator to initiate the charging of the energy storage device 30 and programing the processor 58 with a predetermined code. In one embodiment, the transmitter 24 includes actuator 70 which allows the operator to transmit a second ultrasonic acoustic signal that disarms the receiver 22. This provides advantages in embodiments where the receiver includes a timer that delays the closing of switch 60 for a predetermined amount of time, such as 17 milliseconds to 10 seconds for example. This allows the operator to authorize the detonation and then rescind the command. The transmitter 24 further has an energy source (e.g. a battery) configured to charge the energy source 30 with a sufficient charge to detonate the explosive charge. In the exemplary embodiment, the energy transferred from the transmitter 24 to the receiver 22 is sufficient for a period of four hours.

In other embodiments, the body 62 may include straps or other mounting hardware that allows the transmitter 24 to be mounted on an operator (e.g. on an arm or belt) or to a firearm (e.g. on a stock or barrel).

Figure 8:
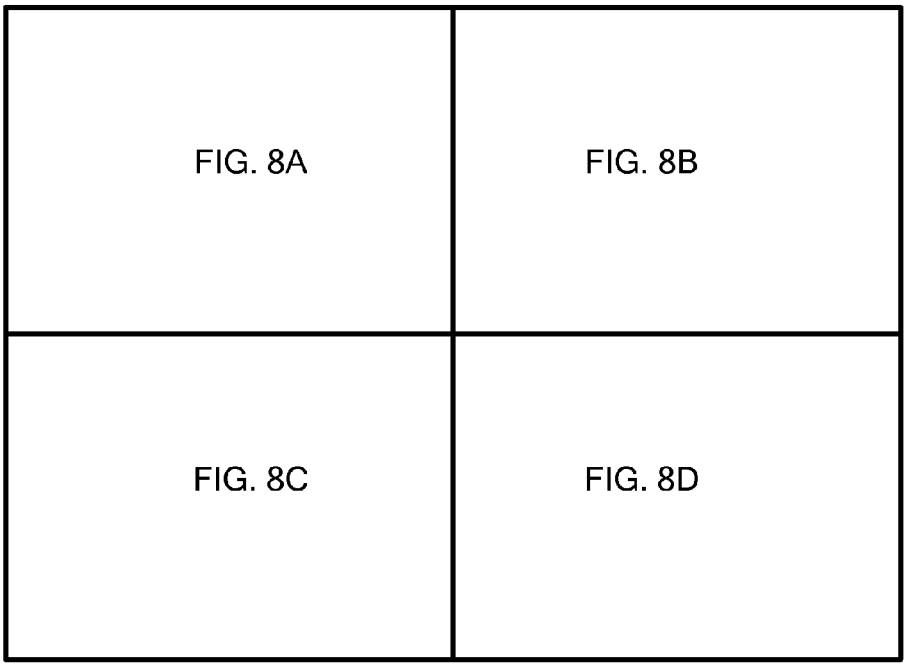
FIG. 8, including
Figure 8A:
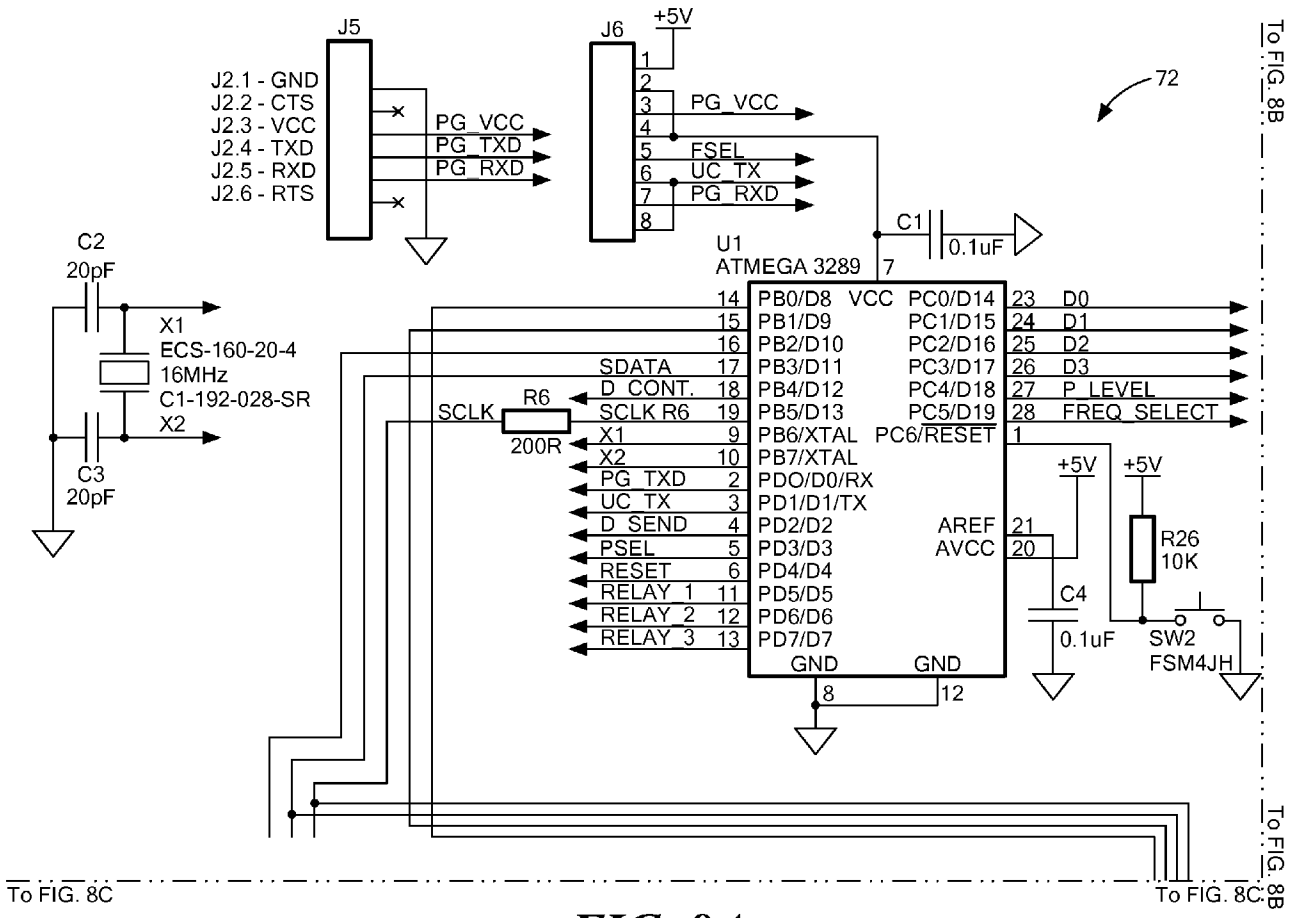
FIGS. 8A - 8D, is a schematic circuit diagram of the control circuit for the transmitter of FIG. 6.
Figure 8B:
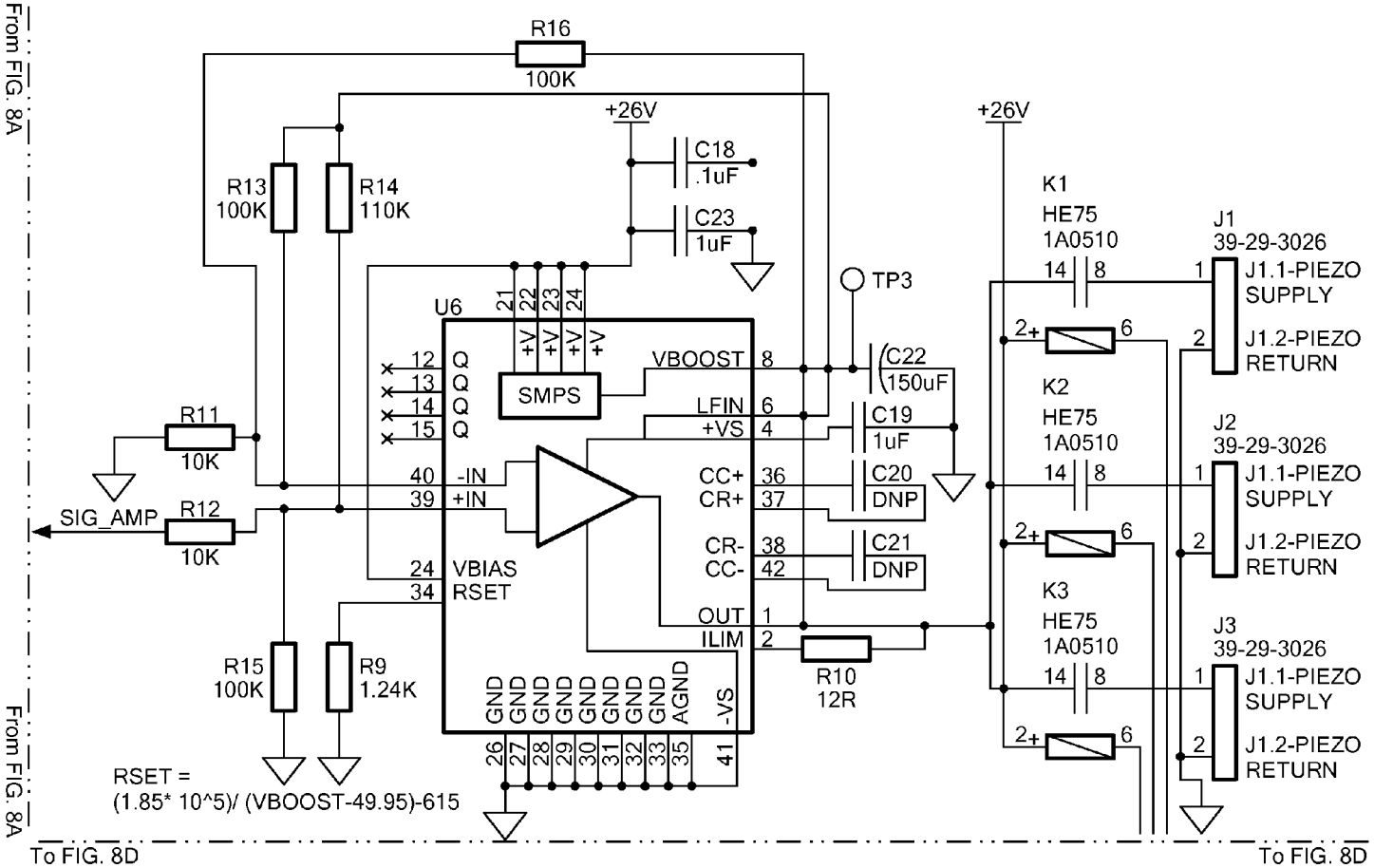
Figure 8C:
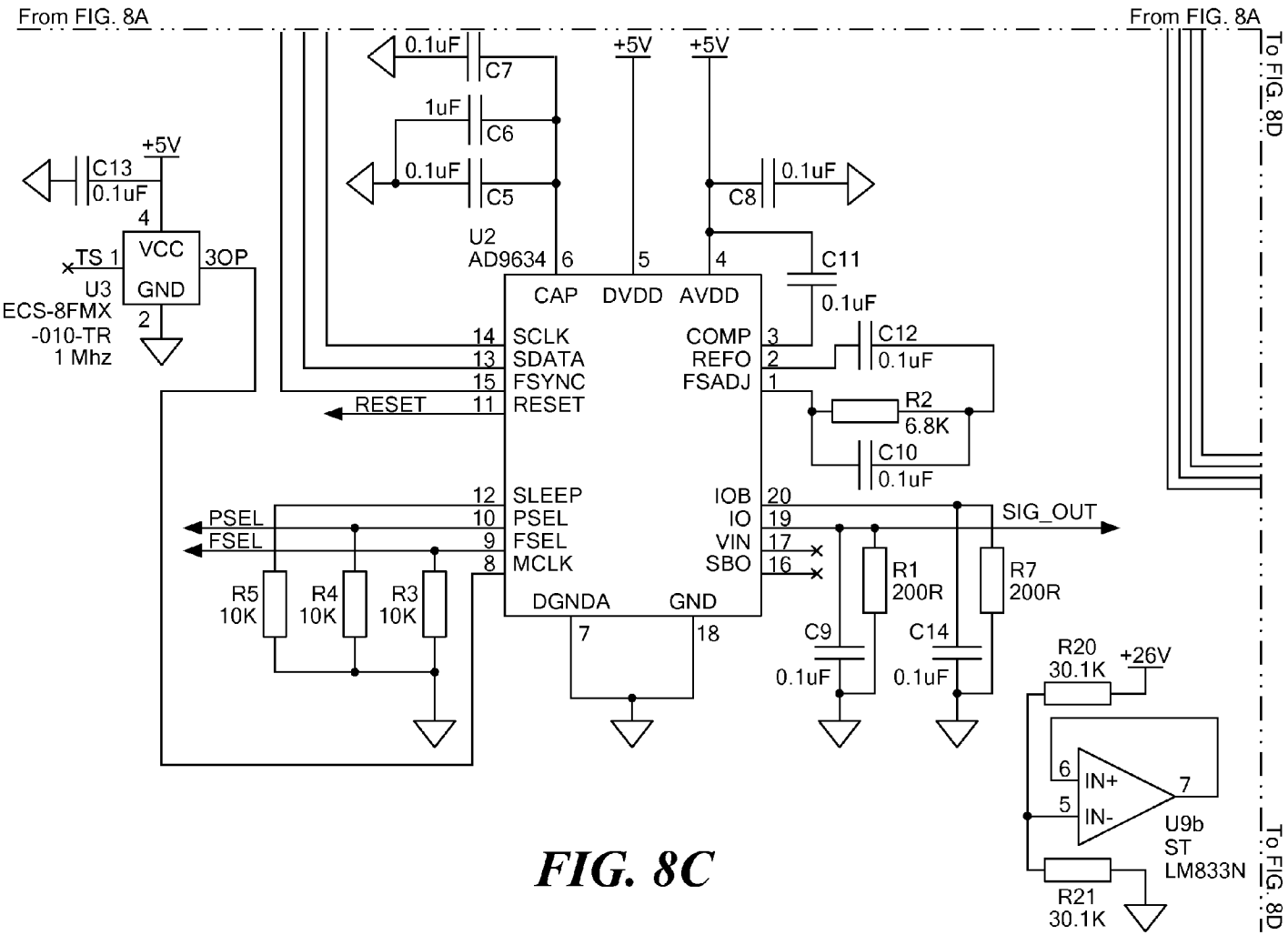
Figure 8D:
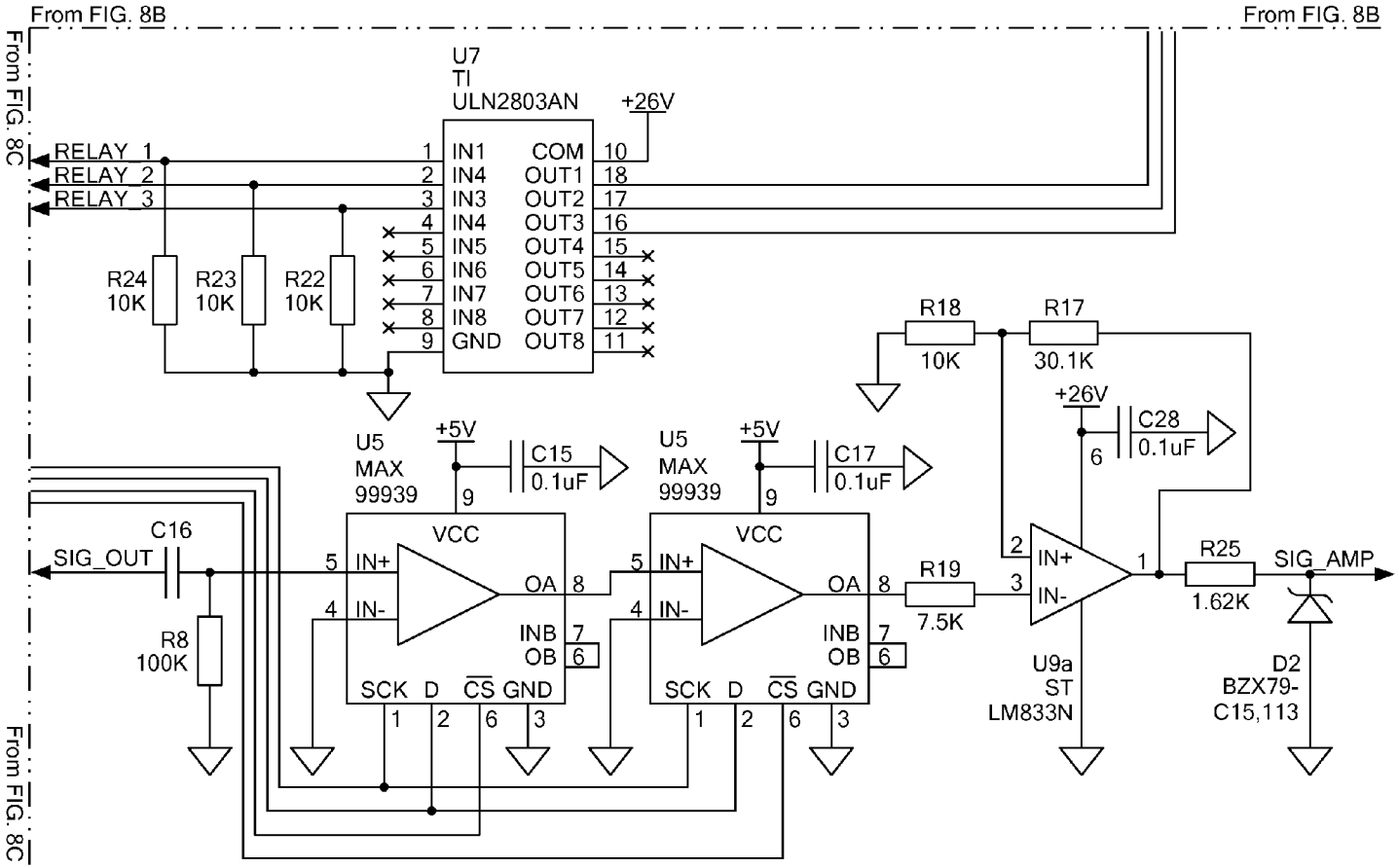
Figure 9:
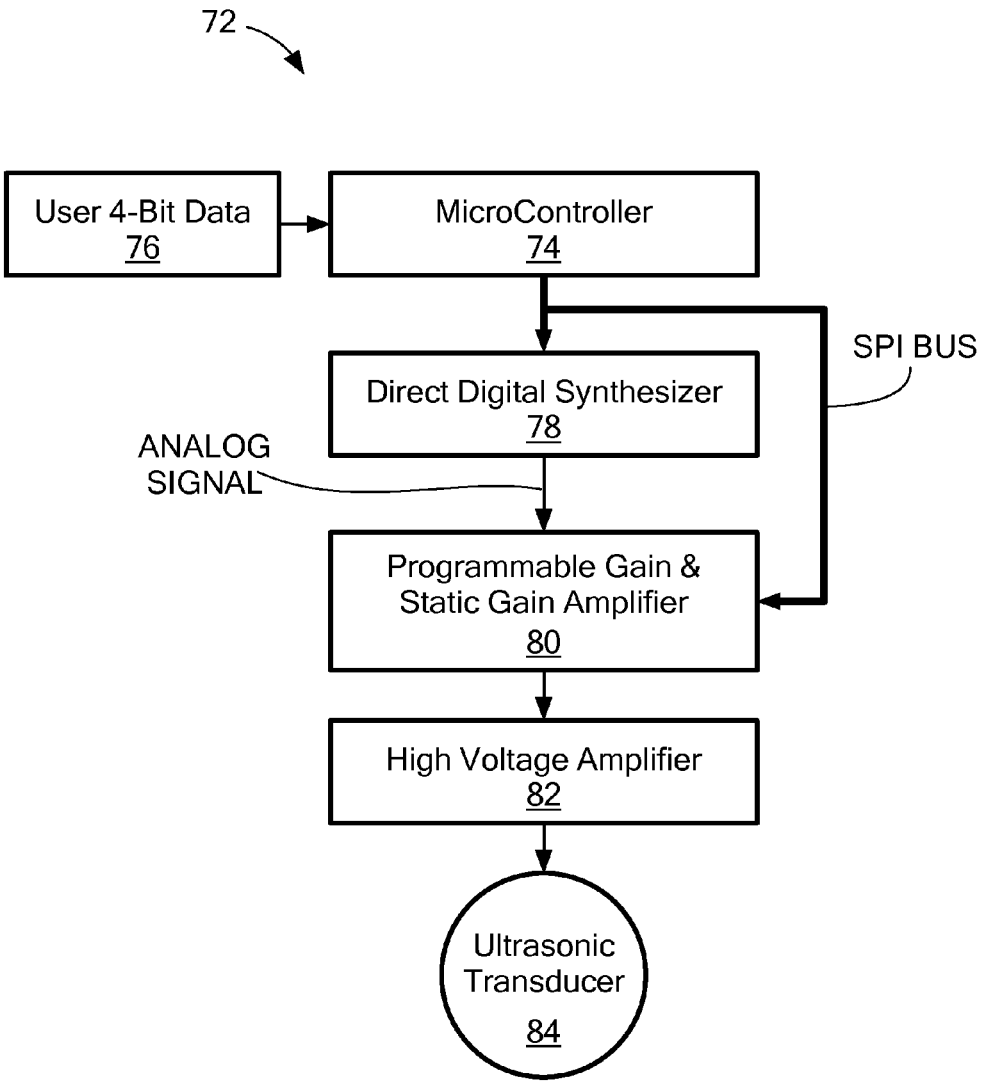
FIG. 9 is a block diagram of the circuit of FIG. 8.

One embodiment of the control circuit 72 of the transmitter 24 is shown in FIGS. 8 and 9. FIG. 8 shows a schematic diagram of an embodiment of the control circuit 72 while FIG. 9 shows the control circuit 72 in a block diagram. Data is transmitted by the transmitter 24 via an On-Off Keying (00K) approach. In one embodiment, a processor 74 receives data 76 (e.g. 4-bit data) and transmits a signal to the direct digital synthesizer 78. In other embodiments, the data 76 may contain more than 4-bits of data. An analog signal incorporating the 4-bit predetermined code is generated by a direct digital synthesizer 78 and then amplified in two stages. The first stage is a Programmable Gain & Static Gain Amplifier 80. In a second stage, a High Voltage Amplifier 82 increases the signal up to 120 $V_{p\text{-}p}$. After amplification the signal transmitted via ultrasonic transducer 84. It should be appreciated that other embodiments simplify this circuit through the use of a digital signal processor (DSP). It was found that the data could be transmitted and decoded reliably at distances up to 120 feet at a baud rate of 5-7 bits/second. In the exemplary embodiment, the transmitter has an effective range between 100-1000 feet. In one embodiment, the transmitter effective range is at least 50 feet with the receiver 22 in a second interior room constructed of wood frame and drywall with a single layer brick exterior surface. In still another embodiment, the transmitter has an effective range of 200 feet from the receiver in a third interior room constructed of wood frame and drywall with a single layer brick exterior surface.

Figure 10:
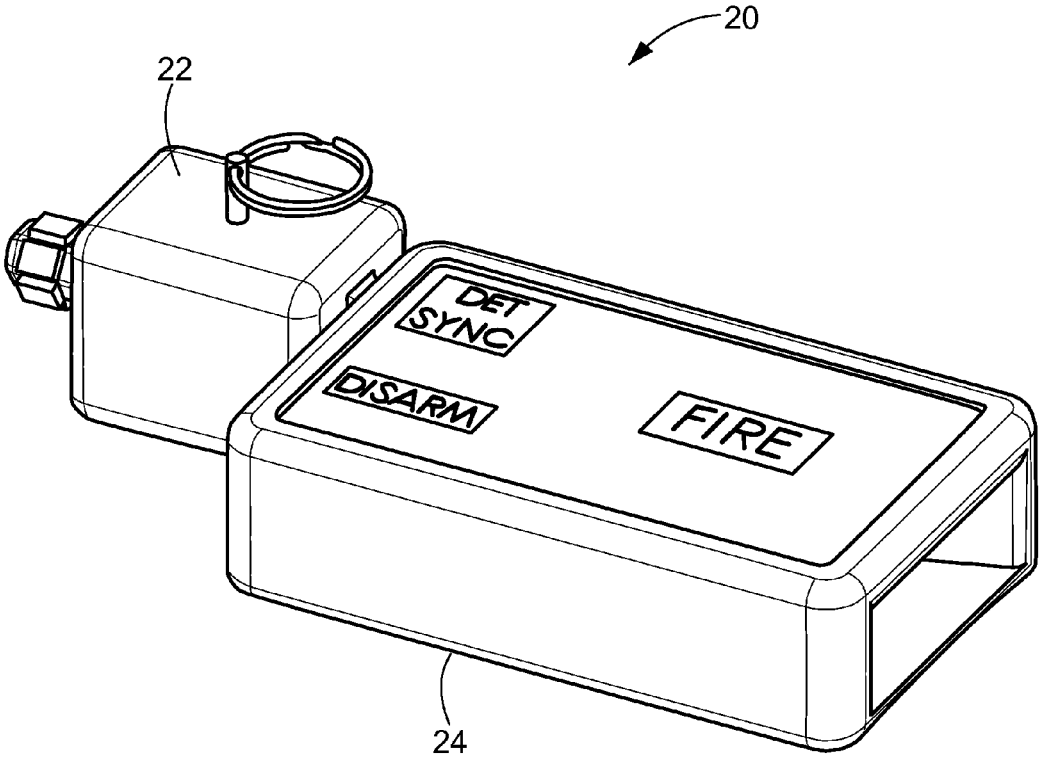
FIG. 10 is a perspective view of the remote detonator assembly in accordance with an embodiment of the invention.
Figure 11:
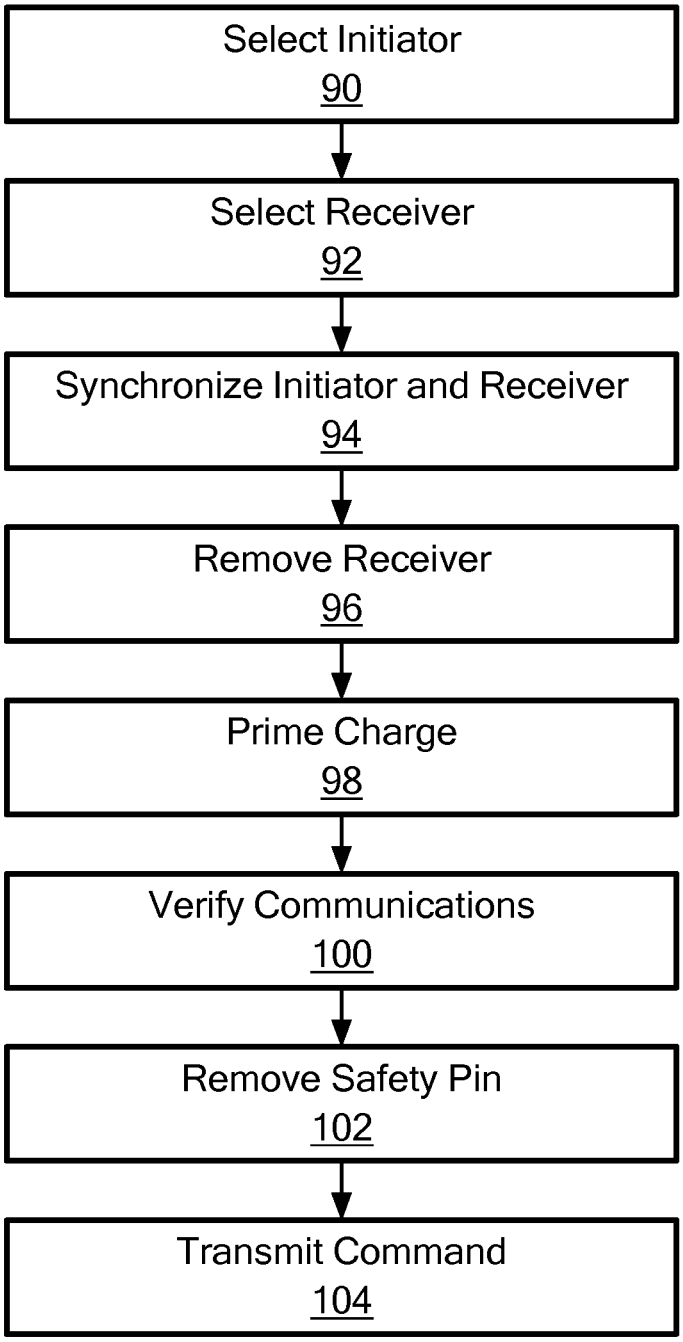
FIG. 11 is a flow diagram on the operator of the remote detonator assembly in accordance with an embodiment of the invention.

Referring now to FIGS. 10 and 11, the operation of the remote detonator system 20 will be described. The operator first selects a receiver 22 in block 90 and inserts the receiver 22 into the transmitter 24 in block 92. The receiver 22 and transmitter 24 are synchronized in block 94. The synchronization step may include several functions, but at a minimum, the transmitter 24 charges the energy storage device 30 with a sufficient charge to detonate the desired charge and also transfers the predetermined code (e.g. 4-bit code) to the processor 58. In other embodiments, the synchronization process may further include transferring a delay or a desired frequency to the receiver 22. When the operator arrives at the desired location, the receiver 96 is removed in block 96 and the detonator is coupled to the explosive charge in block 98. Communication is verified in block 100. In one embodiment communication is verified by an affirmative signal transmitted by the receiver 22, such as via transducer 32 for example, back to the transmitter 24. The transmitter 24 could then provide an indication to the operator that the signal has been received. In one embodiment, the indication is via a light such as an LED. In another embodiment, the transmitter 24 may include a mechanical interlock arrangement that moves in response to receiving the signal. In still other embodiments, the verification signal from the receiver 22 in response to receiving a first signal from the transmitter 24. Where the receiver 22 does not have a capability of transmitting a signal, the verification process may include transmitting a first signal from the transmitter 24 and a visual indicator, such as an LED for example, being actuated.

With the explosive charge in place, the safety pin 34 is removed in block 102 and the receiver is ready to detonate the explosive charge. The personnel move a safe distance away and transmit the ultrasonic acoustic signal in block 104. As discussed above the receive receives the ultrasonic acoustic signal and determines if the signal is at the desired frequency and includes a code that is the same as the predetermined code transmitted to the receiver 22 in block 94. If the received code matches the predetermined code, the switch 60 closes and the electrical current flows to the projection 28 and the explosive charge is detonated.

The use of an acoustic signal provides a number of advantages. Since an acoustic signal is used, the issue of induced currents from stray signals is eliminated. Further, the ultrasonic acoustic signal may be transmitted between rooms. It was found that transmission was completed through a closed solid fire rated wooden door. Ultrasonic signals provide improved penetration of obstacles that would otherwise impede an RF signal, such as but not limited to wet materials and metallic barriers (i.e. shipping containers). The ultrasonic acoustic signal provides still further advantages in allowing for reliable transmission of the signal in a noisy environment, such as a battlefield. Testing was performed during live fire of an AR-15 rifle with a 20" barrel firing a M855 equivalent ammunition. During this testing, the transmitter transducer was positioned 50 feet and 100 feet from the rifle being fired and the receiver transducer was placed 5-10 feet behind the rifle muzzle. Under these conditions, the data received 4 out of 4 times at 50 feet. With the transmitter transducer placed at the muzzle of the rifle being fired, data was received 3 out of 4 times at 100 feet and 2 out of 4 times at 50 feet. It is contemplated that the receiver 22 may be configured to activate during localized low pressure periods to avoid having the pressure wave from the rifle over drive the transducer. Further, it is contemplated that by using digital signal processing techniques to increase communications speed, the data transmission may occur during the window of decreased pressure. To further increase reliability, a higher speed transmission system may be used to transmit the ultrasonic acoustic signal multiple times.

In other embodiments, the transmitter 24 may be configured to synchronize with multiple receivers 22 allowing an operator to detonate multiple charges with the transmission of a single ultrasonic acoustic signal. In other embodiments, the receiver 22 may be configured to synchronize with multiple transmitters 24 to provide redundancy in case a primary transmitter becomes damaged or the operator disabled. In still further embodiments, the receiver 22 includes a timer that delays detonation of the explosive charge for a period of time, such as 17 milliseconds to 10 seconds for example. In one embodiment, the delay period is fixed while in another embodiment the delay period is set by the operator.

It should be appreciated that while the systems and method of communicating using an ultrasonic acoustic signal has been described with respect to a detonation system, the claimed invention should not be so limited. In other embodiments, the ultrasonic acoustic communications arrangement may be used in other applications, including but not limited to coded identification transmissions to friendly forces in real time, secure coded communication between submarines and surface ships, garage door openers, automobile keyless entry systems, and residential/commercial alarm systems. In still other applications, the acoustic communications arrangement may be used for close quarters, non-line-of-sight stealth communication between military personnel or law enforcement officers. The acoustic communications arrangement may also be used for communication between distributed sensor arrays such as those used in area denial weapons or area intrusion alarms. Still further applications may include communications for robots, unmanned ground vehicles (UGVs) or unmanned underwater vehicles (UUV's) particularly for robots that operate in "swarms" of actively or passively coordinated activity in a local area. This could work well in battlefield environments or for disaster response robots in areas cluttered with debris or water that degrades traditional radio frequency communication.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A remote detonator comprising:

a first receiver having a first transducer configured to receive an ultrasonic acoustic signal, the first transducer being electrically coupled to a first controller, the first controller having a processor responsive to executable computer instructions for detonating a first charge in response to the first transducer receiving the ultrasonic acoustic signal; and a transmitter having a second transducer configured to selectively emit the ultrasonic acoustic signal in response to an actuation by an operator.

2. The remote detonator of claim 1 wherein the transmitter includes a second controller electrically coupled to the second transducer, the second controller having a processor responsive to executable computer instructions for incorporating a predetermined code in the ultrasonic acoustic signal.

3. The remote detonator of claim 1 wherein the first receiver further includes a digital signal processor electrically coupled between the first transducer and the first controller, the digital signal processor being configured to filter acoustic signals below a first threshold and above a second threshold.

4. The remote detonator of claim 3 wherein the first transducer outputs a first signal in response to receiving the ultrasonic acoustic signal, and the digital signal processor includes a variable gain amplifier configured to adjust the first signal to be between a low voltage level and a high voltage level.

5. The remote detonator of claim 4 further comprising a tone detector arranged to receive the first signal from the variable gain amplifier, the tone detector configured to transmit a second signal to the first controller in response to the tone detector determining the first signal is a predetermined frequency.

6. The remote detonator of claim 5 wherein the predetermined frequency is 25 kHz.

7. The remote detonator of claim 2 wherein the first receiver is removably coupled to the transmitter, the first receiver further having an energy storage device electrically coupled to receive an electrical charge from the transmitter when the first receiver is coupled to the transmitter.

8. The remote detonator of claim 7 wherein the first controller is electrically coupled for communication to the second controller to receive a fourth signal that includes the predetermined code when the transmitter is coupled with the detonator.

9. The remote detonator of claim 2 wherein the first controller is configured to transmit a fifth signal via the first transducer and the second controller is configured to receive the fifth signal.

10. The remote detonator of claim 1 where in the first controller includes a delay timer configured to delay the detonation of the first charge for a predetermined interval.

11. The remote detonator of claim 10 wherein the delay interval is 17 milliseconds to 10 seconds.

12. The remote detonator of claim 1 further comprising a second receiver having a third transducer configured to receive the ultrasonic acoustic signal, the third transducer being electrically coupled to a first controller, the first controller having a processor responsive to executable computer instructions for detonating a second charge in response to the third transducer receiving the ultrasonic acoustic signal.

13. A remote detonator comprising:

a receiver having a housing with a projection on one side and a first acoustic transducer on an opposite side, the projection including a detonator, the first acoustic transducer configured to receive an ultrasonic acoustic signal, the first acoustic transducer being electrically coupled to a first controller disposed in the housing, the first controller having a processor responsive to executable computer instructions for transferring an electrical charge in response to the first acoustic transducer receiving the ultrasonic acoustic signal; and a transmitter removably coupled to the receiver, the transmitter having a body with an opening sized to receive and electrically couple with the projection, wherein the transmitter configured to emit the ultrasonic acoustic signal in response to a actuation by an operator.

14. The remote donator of claim 13 wherein the receiver further comprises a pin member removably coupled to the receiver and the first controller further includes a circuit electrically coupled between a first energy storage device and an explosive charge, wherein the circuit is configured to transfer the electrical charge from the first energy storage device when the pin is removed.

15. The remote detonator of claim 14 wherein the circuit further comprises a variable gain amplifier and a tone detector electrically coupled in series between the first acoustic transducer and the processor.

16. The remote detonator of claim 15 wherein the circuit further comprises a low noise amplifier electrically coupled in series with a band pass filter between the first acoustic transducer and the variable gain amplifier.

17. The remote detonator of claim 14 wherein the transmitter further comprises a second controller electrically coupled to a second acoustic transducer, the second controller further being coupled to at least one actuator, the second controller including a processor responsive to executable computer instructions for transmitting an ultrasonic acoustic signal in response to the at least one actuator being actuated.

18. The remote detonator of claim 17 wherein the transmitter further comprises a second energy storage device electrically coupled to the second controller, the second energy storage device configured to transfer electrical charge to the first energy storage device when the receiver is coupled to the transmitter.

* * * * *